US007177588B2

(12) United States Patent
Terao et al.

(10) Patent No.: US 7,177,588 B2
(45) Date of Patent: Feb. 13, 2007

(54) SHEET POST-PROCESS APPARATUS AND WAITING TRAY

(75) Inventors: Yasunobu Terao, Tagata-gun (JP); Tokihiko Ise, Tagata-gun (JP); Hajime Yamamoto, Mishima (JP); Reiji Murakami, Yokohama (JP); Hiroyuki Taki, Tagata-gun (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 11/008,222

(22) Filed: Dec. 10, 2004

(65) Prior Publication Data

US 2006/0067767 A1 Mar. 30, 2006

(30) Foreign Application Priority Data

Sep. 28, 2004 (JP) ..... 2004-281774

(51) Int. Cl.
*G03G 15/00* (2006.01)

(52) U.S. Cl. ..... 399/405; 399/407

(58) Field of Classification Search ..... 399/407–410, 399/405; 270/37, 58.07–58.09, 52.18
See application file for complete search history.

(56) References Cited

U.S. PATENT DOCUMENTS 4,473,425 A 9/1984 Baughman et al.
4,611,741 A 9/1986 Wilson
4,794,859 A * 1/1989 Huseby et al. ..... 101/485
4,898,374 A 2/1990 Vermaat
5,021,837 A 6/1991 Uto et al.
5,098,074 A * 3/1992 Mandel et al. ..... 270/58.13
5,282,611 A 2/1994 Ueda et al.
5,285,249 A 2/1994 Mahoney
5,289,251 A 2/1994 Mandel et al.
5,435,544 A 7/1995 Mandel
5,451,037 A 9/1995 Lundstrom
5,628,502 A 5/1997 Amarakoon
5,676,517 A 10/1997 Lotz
5,709,376 A 1/1998 Ushirogata
5,934,140 A 8/1999 Jackson et al.
5,961,274 A 10/1999 Bors
5,971,384 A * 10/1999 Asao ..... 270/58.13
6,065,747 A 5/2000 Khovaylo et al.
6,092,948 A * 7/2000 Altfather ..... 400/625
6,142,461 A 11/2000 Asao et al.
6,231,039 B1 5/2001 Chung
6,330,999 B2 12/2001 Coombs et al.
6,336,630 B1 1/2002 Holtman et al.
6,354,059 B1 3/2002 Yoshie et al.

(Continued)

FOREIGN PATENT DOCUMENTS

JP 62-008965 A 1/1987

(Continued)

*Primary Examiner*—Anthony H. Nguyen
(74) *Attorney, Agent, or Firm*—Foley & Lardner LLP

(57) ABSTRACT

A waiting tray is featured in that left and right lower face support members and for supporting left and right lower faces of a sheet transport direction are rotatably mounted on both of side frames and via rotary shafts and, and the left and right lower face support members are rotated downwardly or upwardly to release a standby state of a sheet retained on the waiting tray in a waiting mode.

14 Claims, 13 Drawing Sheets

U.S. PATENT DOCUMENTS

| | | | |
|---|---|---|---|
| 6,357,753 | B1 | 3/2002 | Yamasaki et al. |
| 6,450,934 | B1 | 9/2002 | Coombs |
| 6,581,922 | B2 | 6/2003 | Kuwata et al. |
| 6,641,129 | B2 | 11/2003 | Ogita et al. |
| 6,659,455 | B2 | 12/2003 | Endo et al. |
| 6,671,492 | B2 | 12/2003 | Mimura et al. |
| 6,698,744 | B2 | 3/2004 | Yamada et al. |
| 6,712,349 | B2 | 3/2004 | Watanabe |
| 6,722,646 | B2 | 4/2004 | Sekiyama et al. |
| 6,722,650 | B1 | 4/2004 | Abbata et al. |
| 6,733,006 | B2 | 5/2004 | Kobayashi et al. |
| 6,733,007 | B2 | 5/2004 | Sekiyama et al. |
| 6,767,012 | B2 | 7/2004 | Sasamoto |
| 6,819,906 | B1 | 11/2004 | Herrmann et al. |
| 6,824,128 | B2 | 11/2004 | Nagata et al. |
| 6,871,042 | B2 | 3/2005 | Nemura et al. |
| 6,910,686 | B2 | 6/2005 | Awano |
| 6,928,259 | B2 | 8/2005 | Sakuma |
| 6,988,728 | B2 | 1/2006 | Kida |
| 2002/0047233 | A1* | 4/2002 | Coombs et al. ..... 270/58.07 |
| 2002/0163119 | A1* | 11/2002 | Kawata ..... 271/207 |
| 2003/0057625 | A1 | 3/2003 | Kuwata et al. |
| 2004/0113348 | A1 | 6/2004 | Awano |
| 2004/0126163 | A1 | 7/2004 | Asami et al. |
| 2004/0181308 | A1 | 9/2004 | Hayashi et al. |
| 2005/0000336 | A1 | 1/2005 | Hattori et al. |

FOREIGN PATENT DOCUMENTS

| | | | |
|---|---|---|---|
| JP | 04-312894 | A | 11/1992 |
| JP | 2583594 | B2 | 11/1996 |
| JP | 2001-089009 | A | 4/2001 |
| JP | 2001-240304 | A | 9/2001 |
| JP | 2003-081517 | A | 3/2003 |

* cited by examiner

SHEET POST-PROCESS APPARATUS AND WAITING TRAY

CROSS-REFERENCE TO RELATED APPLICATIONS

This application is based upon and claims the benefit of priority from prior Japanese Patent Application No. 2004-281774, filed Sep. 28, 2004, the entire contents of which are incorporated herein by reference.

BACKGROUND OF THE INVENTION

1. Field of the Invention

The present invention relates to an apparatus (finisher) for bundling sheets sent from an image forming apparatus, thereby carrying out, for example, staple processing and a waiting tray for use in the post-process apparatus.

2. Description of the Related Art

A post-process apparatus comprises: a processing tray for bundling sheets sent from an image forming apparatus, thereby carrying out, for example, staple processing, and ejecting the processed bundles of sheets; and a storage tray for holding the ejected bundles of sheets. A staple processing speed of the post-process apparatus is slow as compared with an image processing speed of the image forming apparatus. Thus, if a sheet is directly sent to the processing tray, a sheet to be staple processed next is transported while a preceding sheet is staple processed.

In order to prevent this problem, conventionally, a buffer mechanism for adjusting a carrying-in timing of a sheet at a front stage of the processing tray is proposed.

Japanese Patent Document 1: Japanese Patent No. 2583594 discloses a mechanism for retaining sheets is provided at a transport passage for sending sheets sent from an image forming apparatus to a processing tray. However, in this case, there is a need for increasing the transport passage in length, and, as a result, the post-process apparatus is likely to be large in size.

Japanese patent document 2: Jpn. Pat. Appln. KOKAI Publication No. 2001-240304 discloses a mechanism for a sheet support plate of a staple tray to slide in a direction vertical to a sheet transport direction and open in an opposite direction to each other, thereby dropping a bundle of sheets placed on the staple tray onto an elevating tray. However, this mechanism is technically different from that of the present invention in that sliding is carried out.

BRIEF SUMMARY OF THE INVENTION

The Inventors proposes here that a waiting tray is newly allocated as a buffer mechanism at an upper stage of a processing tray. The waiting tray according to this proposal is allocated to be proximal to the upper stage of the processing tray, and a sheet transported from an image forming apparatus to the processing tray is temporarily retained here in a waiting mode. At a time point when retention in a waiting mode is released, that is, at a time point when staple processing of a bundle of sheets at the processing tray terminates, and then, the bundle of sheets is transported from the processing tray to a storage tray, the sheet is supported on a bottom face of the waiting tray. By opening this tray, the sheet is then dropped at the distal end side (upstream side when the sheet is transported to the waiting tray) to the processing tray. By using this waiting tray, equipment can be allocated with a simple mechanism without a need to increase a transport passage in length and providing a space.

As a result, a post-process apparatus can be made compact. Moreover, it is possible to sent the sheets to the processing tray without any malfunction.

It is an object of the present invention to provide a sheet post-process apparatus and a waiting tray for reliably dropping sheets retained on the waiting tray in a waiting mode on a processing tray to improve alignment property of a sheet distal end.

In order to solve the above described problem, the present invention comprises the following features.

1. A sheet post-process apparatus, the apparatus comprising:

a waiting tray which temporarily retains a transported sheet in a waiting mode and releases the retention to drop the sheet;

a processing tray which bundles the sheets dropped from the waiting tray to carry out predetermined processing and ejects the bundled sheets; and an storage tray which holds the bundles of the sheets processed and ejected on the processing tray, wherein the waiting tray comprises:

left and right lower face support members which support left and right lower faces in a sheet transport direction during retention in a waiting mode and release the support of the left and right lower faces during release of the retention;

a shaft which rotatably supports one side face of the left and right lower face support members; and drive means for rotating the left and right lower face support members upwardly or downwardly while the shaft is defined as a rotation center, thereby releasing retention of the sheets.

2. A sheet post-process apparatus according to 1, wherein the waiting tray is allocated proximal to an upper stage of the processing tray, the processing tray and the waiting tray are allocated in an inclined shape which is high at a proximal end side of a sheet to be transported and which is low at a distal end side thereof, the processing tray and the waiting tray are shorter in length of a sheet transport direction thereof than a length of a standard sheet to be held, and a part of the proximal end side in the transport direction of the sheet to be held on the processing is held on the storage tray.

3. A waiting tray for temporarily retaining a transported sheet in a waiting mode, followed by releasing the retention, thereby making it possible to drop the sheet on a processing tray, the waiting tray comprising:

a processing tray which bundles the sheets dropped from the waiting tray to carry out predetermined processing and eject the bundled sheets;

a shaft which rotatably supports one side face of left and right lower face support members; and drive means for rotating the left and right lower face support members upwardly or downwardly while the shaft is defined as a rotation center, thereby releasing retention of the sheets.

4. A sheet post-process apparatus, the apparatus comprising:

waiting means for temporarily retaining a transported sheet in a waiting mode and releasing the retention to drop the sheet;

processing means for bundling the sheets dropped from the waiting means to carry out predetermined processing and eject the bundled sheets; and storage means for holding the bundles of sheets processed and ejected by the processing means, wherein the waiting means comprises:

left and right lower face support means for supporting left and right lower faces in a sheet transport direction during retention in a waiting mode and releasing the support of the left and right lower faces during release of the retention;

shaft means for rotatably supporting one side face of the left and right lower face support means; and drive means for rotating the left and right lower face support means upwardly or downwardly while the shaft is defined as a rotation center, thereby releasing retention of the sheets.

In the present specification and claims, a proximal end side, a distal end side, and a sheet width are defined as follows. That is, when a transport direction of a sheet to be transported to a waiting tray is defined as a reference, a downstream side in the transport direction is defined as a proximal end side; an upstream side in the transport direction is defined as a distal end side; and a length in a transverse direction when the sheet transport direction is defined as a longitudinal direction is defined as a sheet width. In addition, a sheet denotes a copy sheet on which a toner image (developed image) is copied and which is sent from the image forming apparatus.

According to the present invention, left and right sheet lower face support members are turned upwardly or downwardly to release retention of a sheet in a waiting mode. Thus, although a mechanism for sliding the sheet lower face support members requires a space in a transverse direction, this space is not required in the present invention. In addition, there is a less danger that a sheet is pulled to one of the left and right support members, and the distal end of the processing tray is held with good alignment property.

BRIEF DESCRIPTION OF THE SEVERAL VIEWS OF THE DRAWING

FIGS. 19A and 19B are views each illustrating an operation of a waiting tray showing one embodiment of the present invention, wherein FIG. 19A shows a state in which a sheet is retained in a waiting mode, and FIG. 19B shows a state in which retention of a sheet in a waiting mode is released; and FIGS. 20A and 20B are views each illustrating an operation of another waiting tray showing one embodiment of the present invention, wherein FIG. 19A shows a state in which a sheet is retained in a waiting mode, and FIG. 19B shows a state in which retention of a sheet in a waiting mode is released.

DETAILED DESCRIPTION OF THE INVENTION

Now, one embodiment of the present invention will be described here.

(General Description of Image Forming Apparatus)

Figure 18:
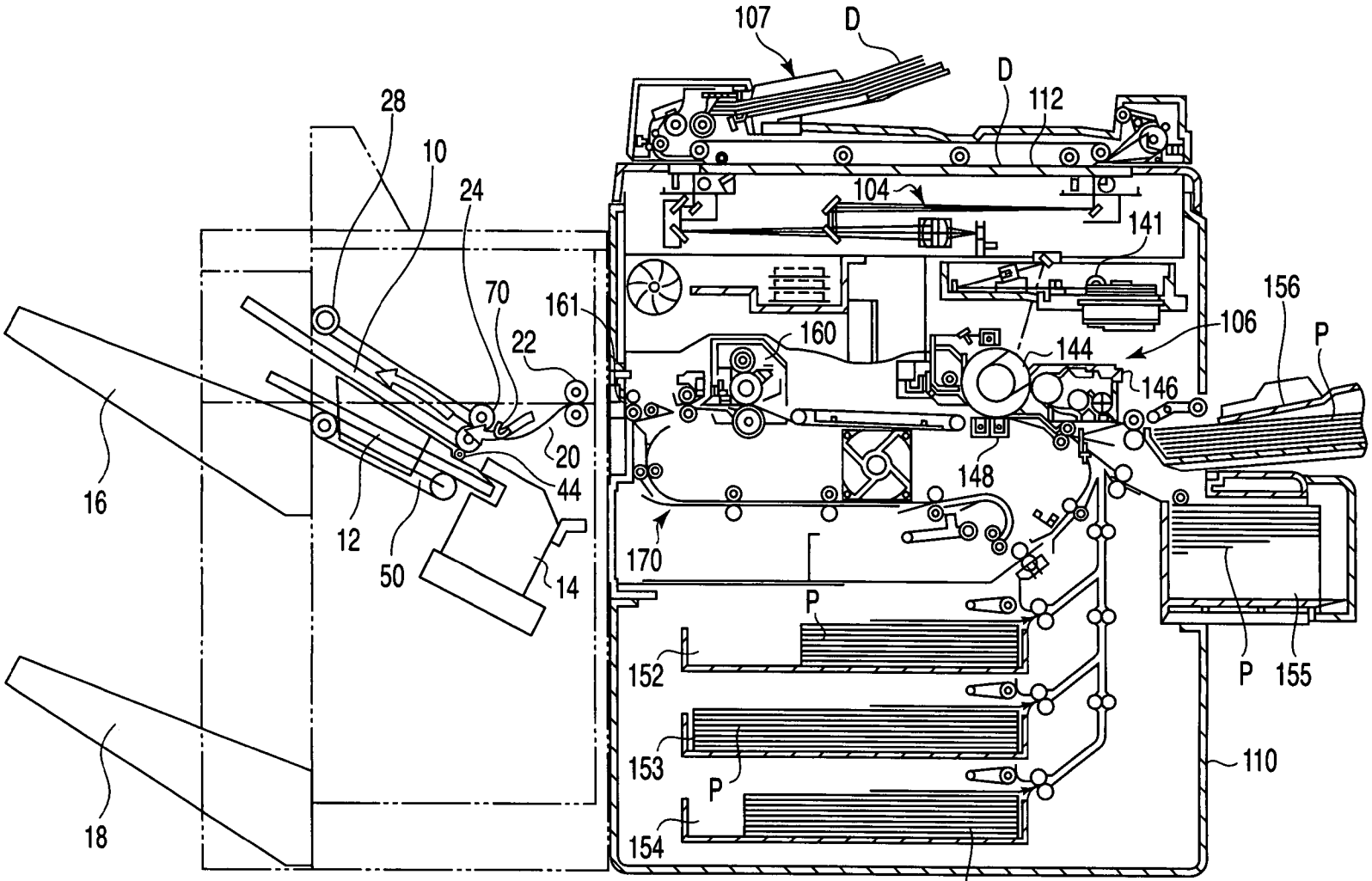
FIG. 18 is a view showing a combination of the post-process apparatus and the image forming apparatus according to the present invention.

A general description of an image forming apparatus (digital copying machine) allocated at a front stage of a post-process apparatus according to the present invention will be given with reference to FIG. 18. A manuscript placement base 112 is provided at an upper face of this apparatus. An auto document feeder 117 (hereinafter, referred to as an ADF) for automatically feeding a document D onto the manuscript placement base 112 is allocated on the manuscript placement base. The manuscript D is placed on the ADF, predetermined settings (such as the presence of absence of staple processing, how to carry out staple processing, the number of copies, or size of sheet to be copied, for example), and then, a copy start button is pressed. The manuscript D on the ADF is transported to a predetermined location of the manuscript placement base 112.

A scanner unit 4, a printer unit 6, and a copy sheet cassette and feeder are arranged at the inside of the image forming apparatus. At the scanner unit 4, the manuscript D on the manuscript placement base 112 is scanned, and reflection light thereof is incident. The incident reflection light is converted in a photoelectric manner, image information on the manuscript D is read, and a photoelectric signal corresponding to the read image information is output. At the printer unit 6, according to the image information or the like on the manuscript D read by the scanner unit 4, an electrostatic latent image is formed on a peripheral face of a photosensitive drum 144 by a semiconductor laser 141. Then, a toner is supplied from a developing device 146 to the photosensitive drum 144; the electrostatic latent image formed on the photosensitive drum 144 is substantially produced, and a tone image is formed.

To this photosensitive drum 144, a copy sheet P is sent from cassettes 52, 53, 54, and 56 or a feeder 55 of the copy sheet P, and the toner image on the photosensitive drum 144 is copied onto the copy sheet by a transfer charger 148. Then, the toner image of the copy sheet is fixed by a fixing device 160, and the fixed toner image is ejected from an ejection port 161. This sheet comes under the sheet of the present specification and claims.

In a control circuit of the image forming apparatus side, information concerning a sheet such as sheet size, the presence or absence of sort, or the presence or absence of staple processing is entered by operator's data input and/or an input signal from sensor means provided in the image forming apparatus. The control circuit at the image forming apparatus side sends information concerning a sheet transported to the control circuit of the post-process apparatus side based on these items of information. The information includes the following. For example, the sheet is provided as a sheet retained in the waiting tray in a waiting mode, the sheet being a sheet other than a last sheet to be held. The sheet is provided as a sheet retained in the standby sheet in a waiting mode, the sheet being a last sheet to be held. The sheet is provided as a sheet retained in the waiting tray in a waiting mode (a sheet being directly dropped on the processing sheet). The sheet is provided as a sheet being directly ejected to the storage tray without being dropped on the waiting tray. Information concerning dimensions of a sheet to be transported to the post-process apparatus (such as A3 or A4 size, for example) or sheet length (such as ordinary paper or a variety of cardboards, for example) is also sent from a control circuit at the image forming apparatus side to a control circuit at the post-process apparatus side.

Information concerning a length of a sheet which is larger than that of a set sheet is sensed by a sensor provided in the post-process apparatus. The sensed information is sent from this sensor to the control circuit at the post-process apparatus side.

(General Description of Post-process Apparatus)

A general description of the post-process apparatus will be given with reference to FIG. 18. The post-process apparatus is provided as an apparatus for bundling sheets 20 transported from an image forming apparatus, thereby carrying out staple processing or the like. This post-process apparatus is allocated in contact with the ejection port 161 of the image forming apparatus. That is, a sheet transport inlet is provided in association with the ejection port 161 of the image forming apparatus, and an inlet roller 22 is allocated in this sheet transport inlet. The inlet roller 22 introduces the sheets 20 into a paper pass ceiling 36 for forming a transport passage in the post-process apparatus (refer to FIG. 1). This paper pass ceiling 36 guides a sheet to a waiting tray 10 and a processing tray 12. Two storage trays 16 and 18 are allocated at the downstream side of the processing tray 12 (at the downstream side of the waiting tray 10).

The waiting tray 10 is allocated to be proximal to the upper stage of the processing tray 12 while the waiting tray is inclined so as to be upward at the proximal end side of the sheet to be transported and so as to be downward at the distal end side. A paper feed roller 24 is provided at the distal end side of this waiting tray 10 (at the upstream side of the sheet to be transported), and a waiting tray roller 28 is provided at the proximal end side of the tray (at the downstream side of the sheet to be transported). A sheet sensor 70 is provided at the transport inlet of the paper feed roller 24. This sensor senses a proximal end and a distal end of the sheet to be transported.

The processing tray 12 is allocated at the lower stage of the processing tray 12 while the processing tray is inclined so as to be upward at the proximal end side of the sheet (at the downward side of the sheet to be transported to the storage tray) and so as to be downward at the distal end side (upstream side of the sheet to be transported to the ejected paper storage tray). A stapler 14 is provided at the distal end side of the processing tray 12. A transport mechanism 50 is provided on the processing tray 12 so as to transport a bundle of staple processed sheets or the like to the storage tray 16 or 18.

Here, in the post-process apparatus according to the present invention, the waiting tray 10 and the processing try 12 both are small in size, as compared with the size of sheet to be transported in order to make equipment compact. Since the waiting tray 12 is small in size than a sheet to be held thereon, when a sheet is dropped from the waiting tray 10 to the processing tray 12, that sheet is held across the processing tray 12 and the storage tray 16 (or 18) (refer to FIGS. 10 to 13).

A control circuit of the post-process apparatus controls the waiting tray 10 to make a proper operation based on information concerning a sheet obtained from the control circuit at the image forming apparatus side and information available from the sheet sensor 70.

For example, when a sheet transported to the waiting tray is provided as a sheet which should be retained on the waiting tray in a waiting mode, the sheet being a sheet other than a last sheet to be held, this sheet is kept to be held in a proper location of the waiting tray.

When the above sheet is provided as a sheet to be retained on the standby sheet in a waiting mode, the sheet being a last sheet to be held, that sheet is aligned in a proper location, and is dropped on the processing tray together with the sheet which has been held in advance on the waiting tray.

When the sheet is provided as a sheet which is not required to be retained on the waiting tray in a waiting mode, that sheet is directly dropped on the processing tray.

When the sheet is provided as a sheet to be directly ejected on the storage tray without being dropped on the processing tray, that sheet is directly transported from the waiting tray to the storage tray without intervening the processing tray.

When the sheet is provided as a sheet which is larger than a set sheet (for example, a sheet of A3 in size), the waiting tray is increased in length by expanding it.

<Waiting Tray>

Figure 1:
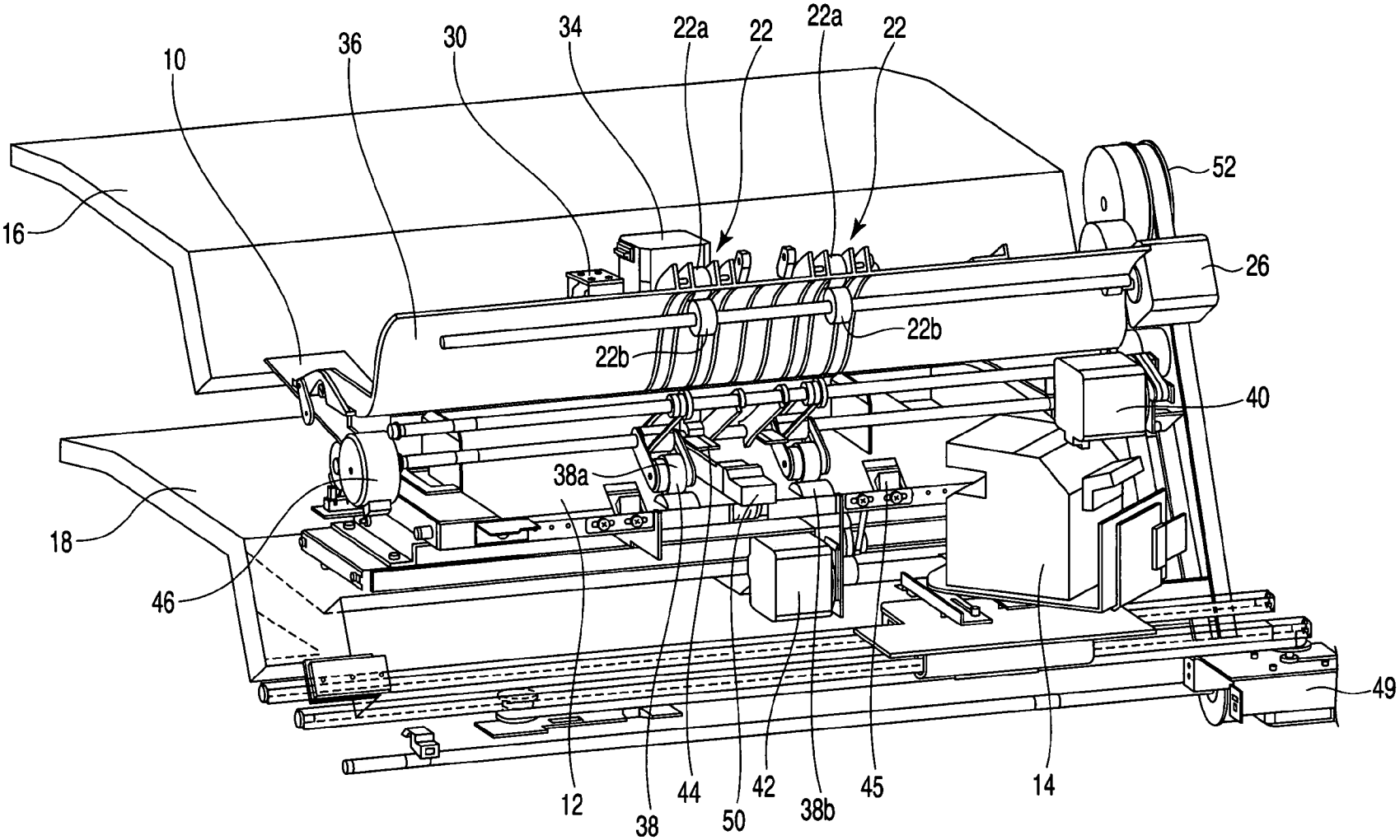
FIG. 1 is a perspective view of a post-process apparatus showing one embodiment of the present invention.
Figure 2:
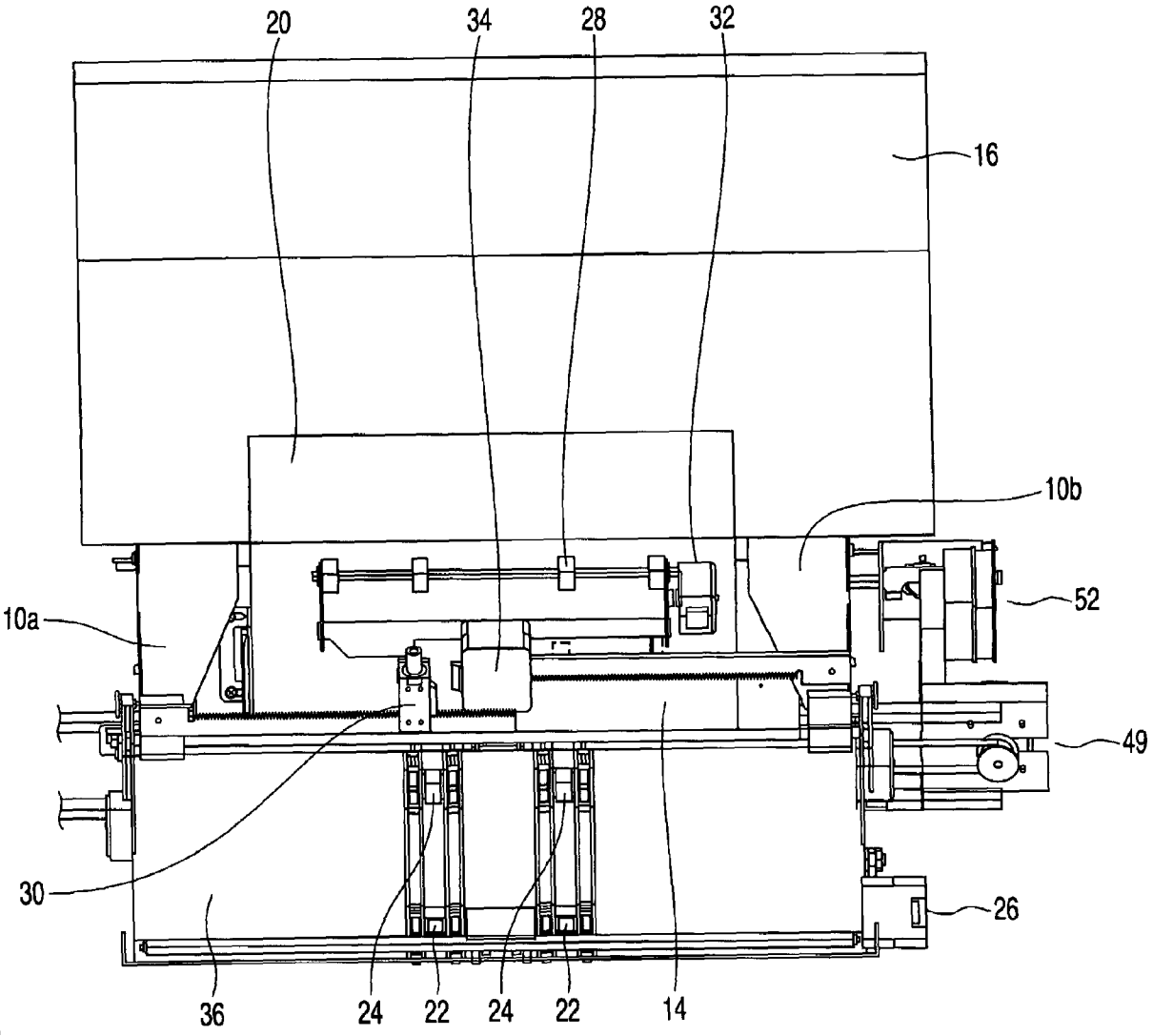
FIG. 2 is a top view of the post-process apparatus showing one embodiment of the invention.
Figure 3:
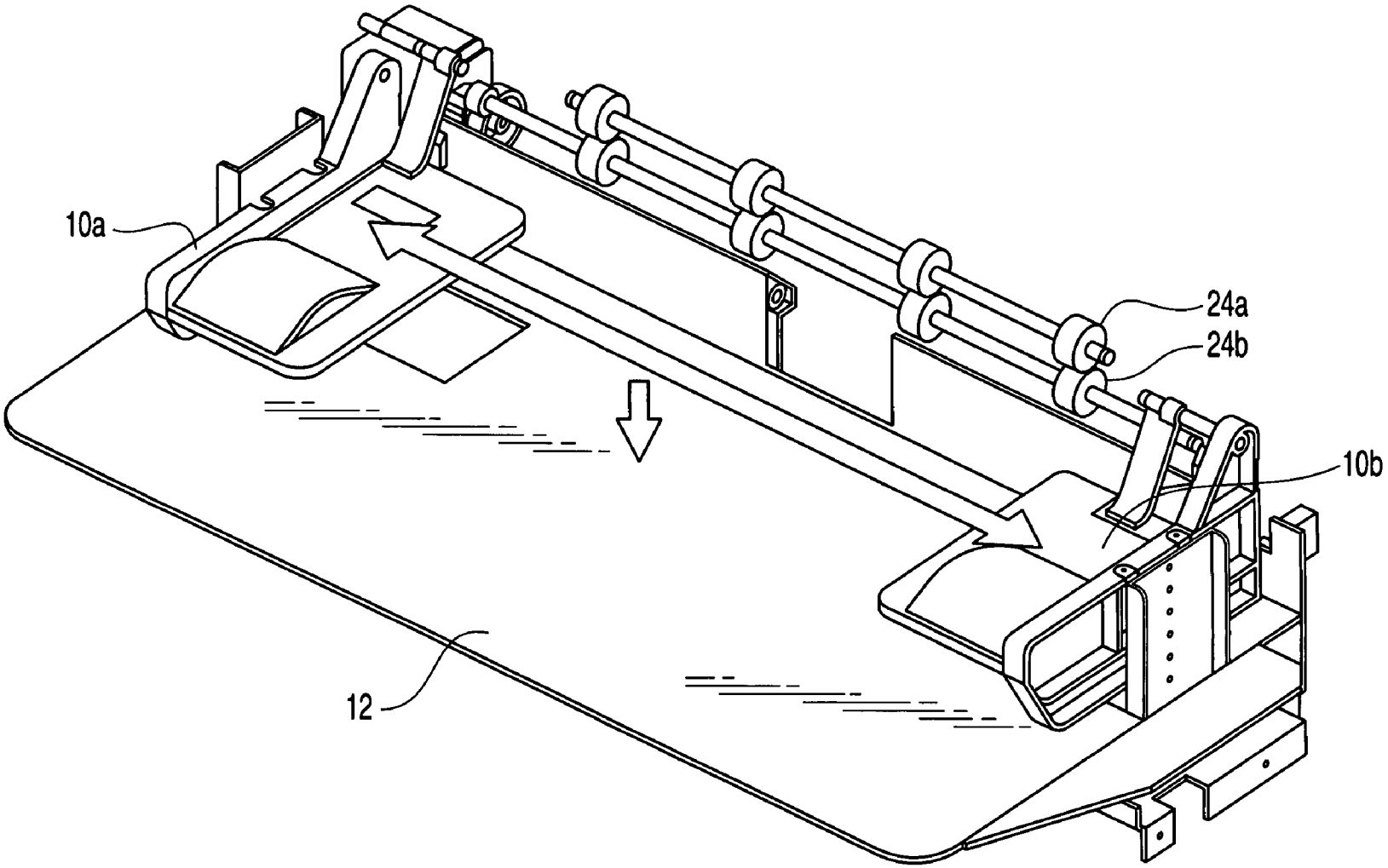
FIG. 3 is a view illustrating an operation of a waiting tray showing one embodiment of the invention.

The waiting tray will be described with reference to FIGS. 1, 2 and 3. As has been already described, when a preceding sheet is processed on the processing tray, a next sheet cannot be transported to the processing tray. The waiting tray makes the next sheet standby in this state. The inlet roller 22 includes an upper inlet roller 22*a* and a lower inlet roller 22*b*. These rollers are driven by an inlet roller motor 26. The paper feed roller 24 includes an upper paper feed roller 24*a* and a lower paper feed roller 24*b*. These rollers are driven by a paper feed roller motor. The waiting tray roller 28 can be operated to be vertically elevated. This vertically elevating operation is controlled by a waiting tray roller drive source 30. The waiting tray roller 28 enables normal and inverting rotation. This normal and inverting rotation is carried out by a waiting tray roller motor 32.

Figure 19A:
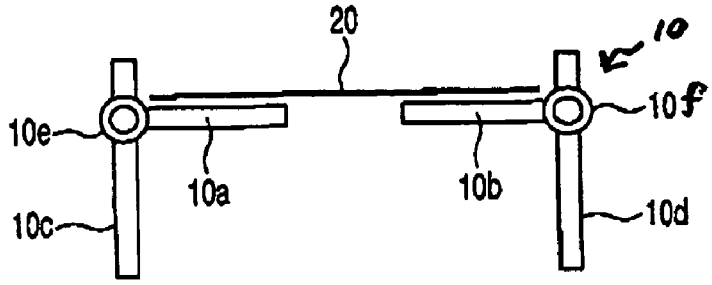
Figure 20A:
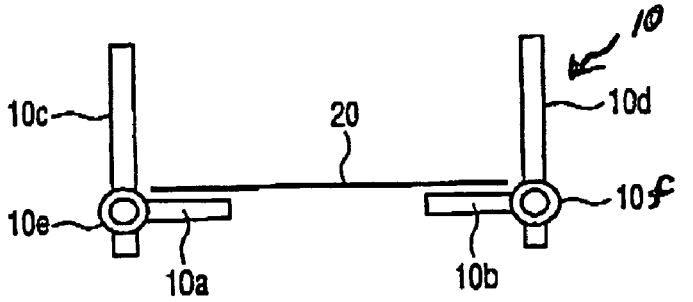

The waiting tray 10 comprises left and right lower face support members 10*a* and 10*b* for supporting these left and right lower faces in a transport direction of a sheet transmitted to the waiting tray, as shown in FIG. 19A or 20A. These left and right lower face support members 10*a* and 10*b* each have one side face along the sheet transport direction rotatably mounted on frame bodies 10*c* and 10*d* via rotary shafts 10*e* and 10*f*. In this example, the widths of the left and right lower face support members are equal to each other in length at their proximal end side and at its distal end side.

Figure 19B:
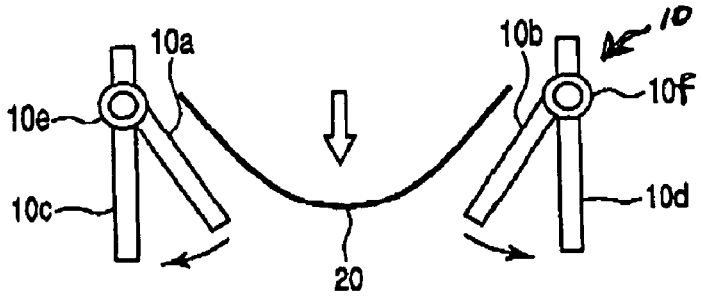
Figure 20B:
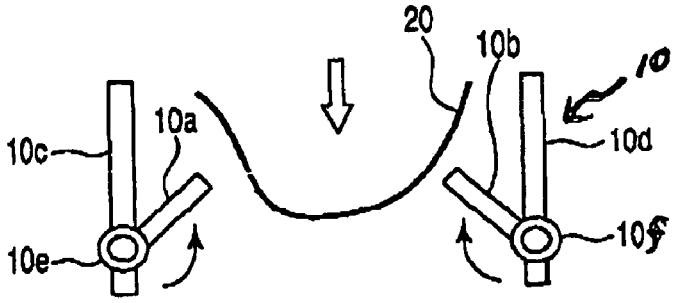

These rotary shafts 10*e* and 10*f* are connected to a drive motor for rotating the left and right lower face support members downwardly or upwardly while one side face mounted on both side frames is defined as a rotation center. Therefore, although the left and right lower face support members are set in a location for retaining a sheet in a waiting mode shown in FIG. 19A or 20A, when retention in a waiting mode is released, a drive motor is rotated to open the left and right lower face support members in a downward direction (FIG. 19B) or in an upward direction (FIG. 20B). In this manner, the sheet can be dropped onto the processing tray.

The waiting tray roller 28 returns the sheet transported to the waiting tray to the distal end side, and aligns the sheet distal end by abutting the sheet distal end against a distal end 60 of the waiting tray. In this case, although the sheets are located upwardly when they are transported to the waiting tray, the roller is lowered in the case where the sheet distal end is aligned. Then, the sheets are rotated while the sheets are compressed, and the sheets are pushed back. In addition, in the case where the sheets are transported from the waiting tray directly to the storage tray, the waiting roller is lowered and is rotated while the sheets are compressed, and the sheets are ejected. In this case, the rotation direction of the waiting tray roller 28 becomes inverted from that in the case where the sheets are abutted against the distal end side.

On the waiting tray, there is provided the sheet sensor 70 (refer to FIG. 18 or the like) for sensing a sheet to be proximal to the paper feed roller 24, i.e., at a side (upstream side) at which a sheet is carried in the waiting tray. This sheet sensor 70 senses the start of transport (sheet proximal end) by the paper feed roller 24 and the end of transport (sheet distal end) by the sheer feed roller 24. This sense signal is fed to control means of the post-process apparatus.

As shown in FIG. 19, the control means of the post-process apparatus receives information, such as the presence or absence of staple processing, how to carry out staple processing, the number of copies, and size of sheet to be copied, from the control means of the image processing apparatus, and senses whether the sheet to be transported to the waiting tray is provided as a sheet which should be retained on the waiting tray in a waiting mode or a sheet which is not required to be retained in a waiting mode. For example, based on information indicating how to carry out staple processing, this control means senses that a first sheet and a second sheet are provided as sheets to be retained on the waiting tray in a waiting mode and the third and subsequent sheets are provided as sheets which are not required to be retained in a waiting mode. Alternatively, the control means senses that retention on the waiting tray in a waiting mode is not required from the information indicating that no staple processing is carried out. Further, the control means receives a signal from the sheet sensor 70, and senses a transported state of the sheet to the waiting tray 10. Then, the control means of the post-process apparatus instructs the drive motor of the lower face support members 10*a* and 10*b* to output a control signal indicating a release timing or a release quantity (release width) of the left and right lower face support members 10*a* and 10*b*, thereby properly dropping the sheet onto the processing tray 12 with a proper timing.

On the other hand, in the case where the sheet transported to the waiting tray is provided as a sheet which is not required to be retained on the waiting tray in a waiting mode, the left and right lower face support members 10*a* and 10*b* are released. As a result, the sheet is dropped onto the processing tray without passing the waiting tray.

<Processing Tray>

The processing tray carries out longitudinal and transverse alignments with respect to a bundle of sheets dropped from the waiting tray and carries out predetermined processing (for example, staple processing). This processing tray is allocated in an inclined shape which is high at its proximal end side and which is low at its distal end side.

Figure 4:
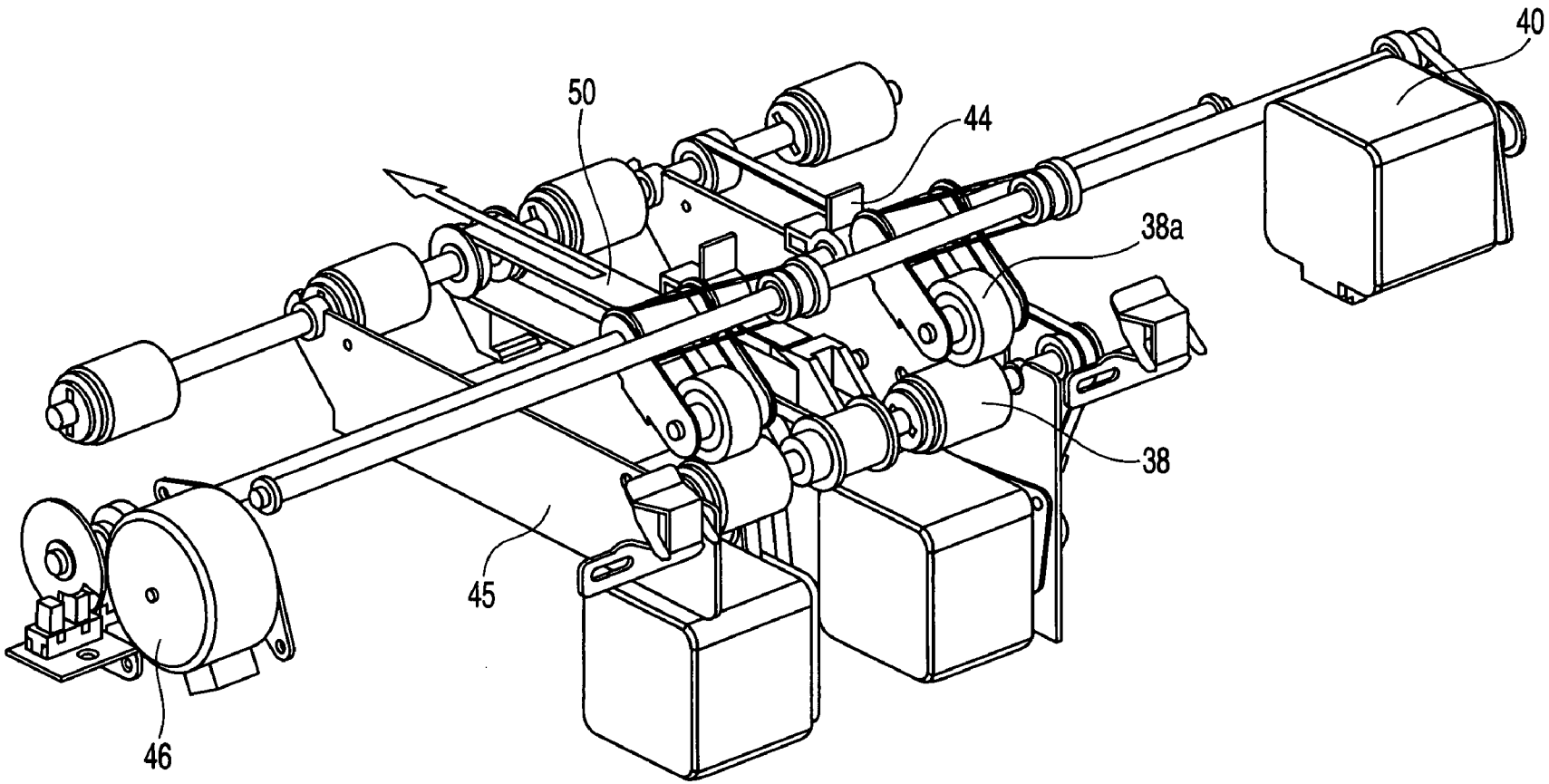
FIG. 4 is a view illustrating a longitudinal alignment and sheet bundle transport mechanism of the post-process apparatus showing one embodiment of the invention.

As shown in FIG. 4, longitudinal alignment is carried out by a longitudinal alignment roller 38. A longitudinal alignment upper roller 38*a* is driven by a longitudinal alignment upper roller motor 40. A longitudinal alignment lower roller 38*b* is driven by a longitudinal alignment lower roller motor 42. Then, sheets are aligned while a stopper 45 is defined as a reference. In addition, in order to assist this alignment, a paddle 44 is provided. This paddle 44 is driven by a paddle motor 46.

Figure 5:
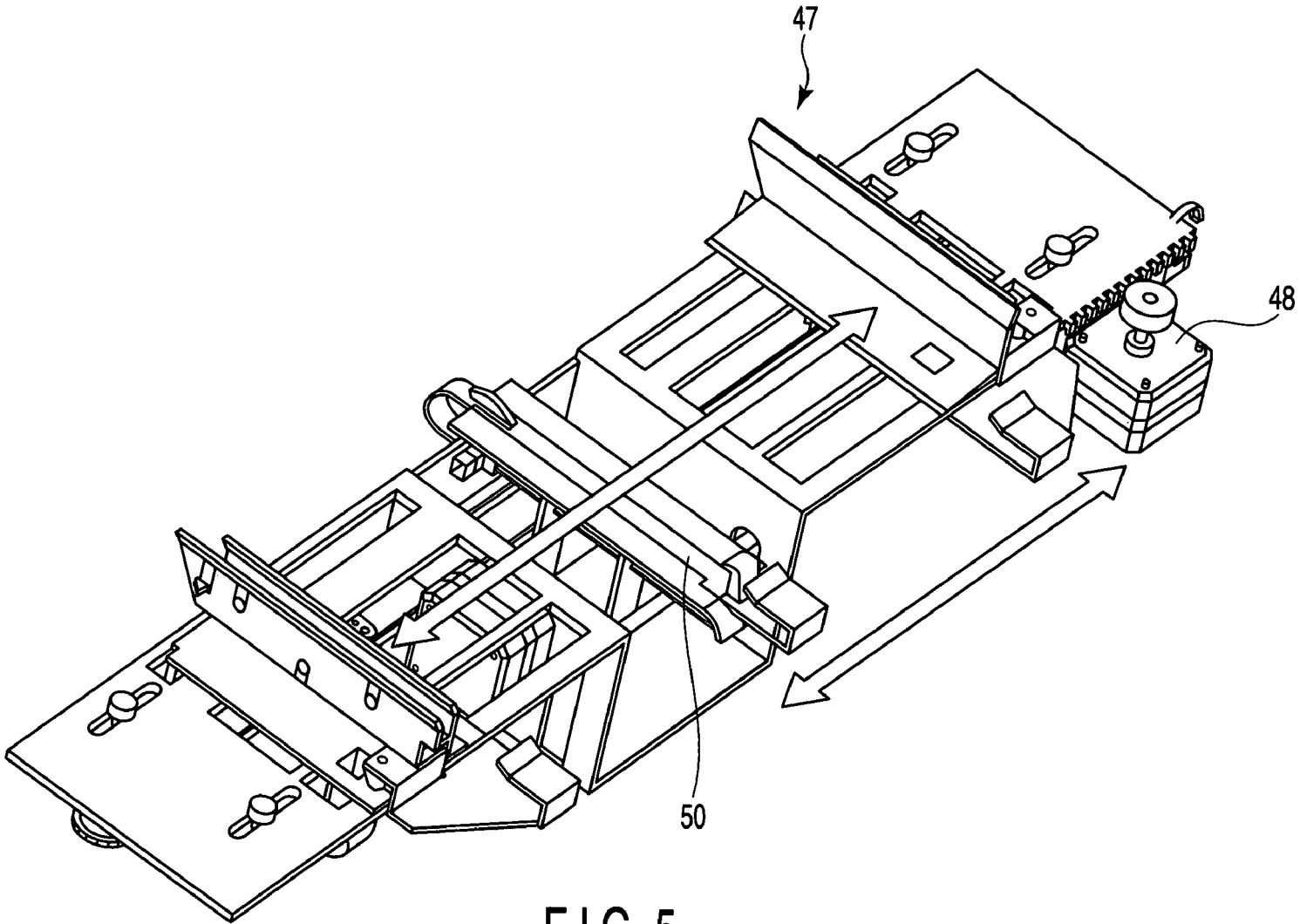
FIG. 5 is a view illustrating a transverse alignment mechanism of the post-process apparatus showing one embodiment of the invention.

As shown in FIG. 5, transverse alignment is executed by a transverse alignment mechanism 47 and a transverse alignment motor 48.

On the processing tray 12, when a predetermined number of sheets is aligned and stacked, staple processing is carried out by the stapler 14.

Figure 6:
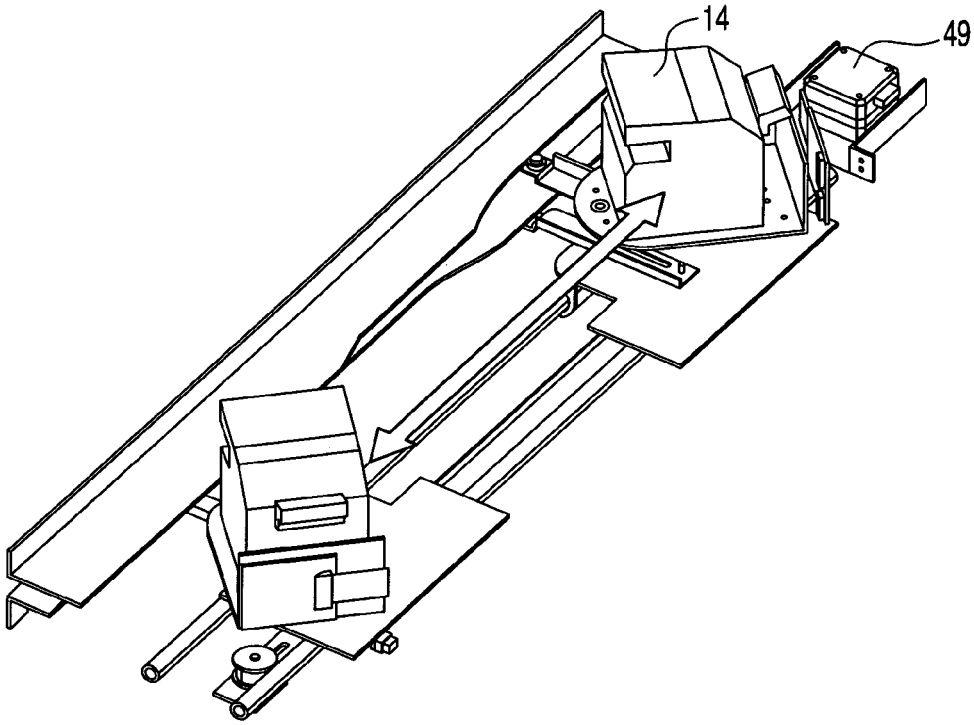
FIG. 6 is a view illustrating an operation of a stapler of the post-process apparatus showing one embodiment of the invention.
Figure 7:
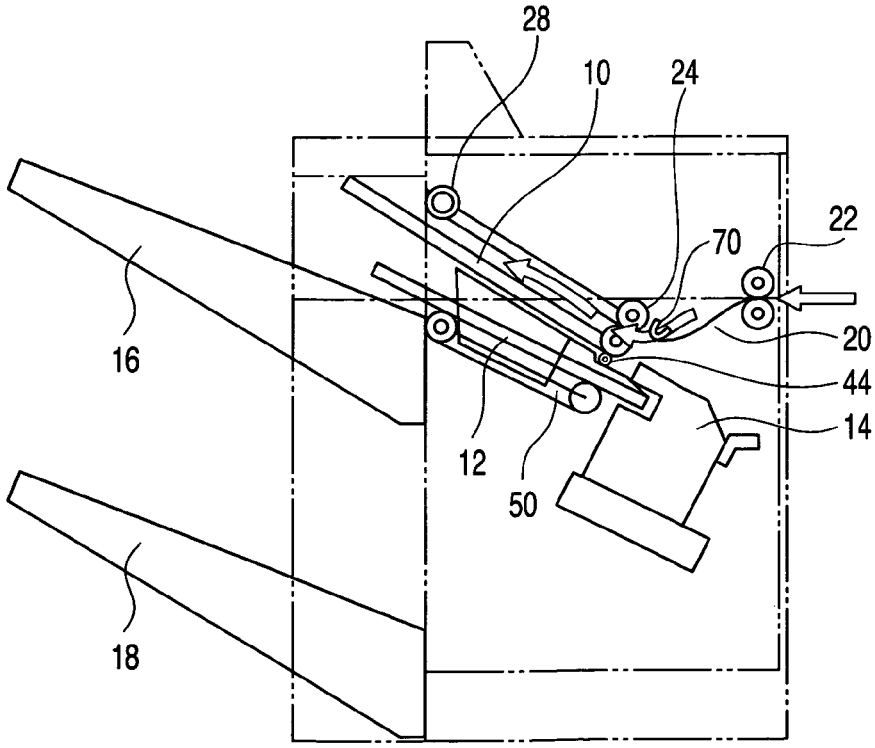
FIG. 7 is a view illustrating a flow of a first sheet of sheets between an inlet roller and a paper feed roller in the post-process apparatus showing one embodiment of the invention.
Figure 8:
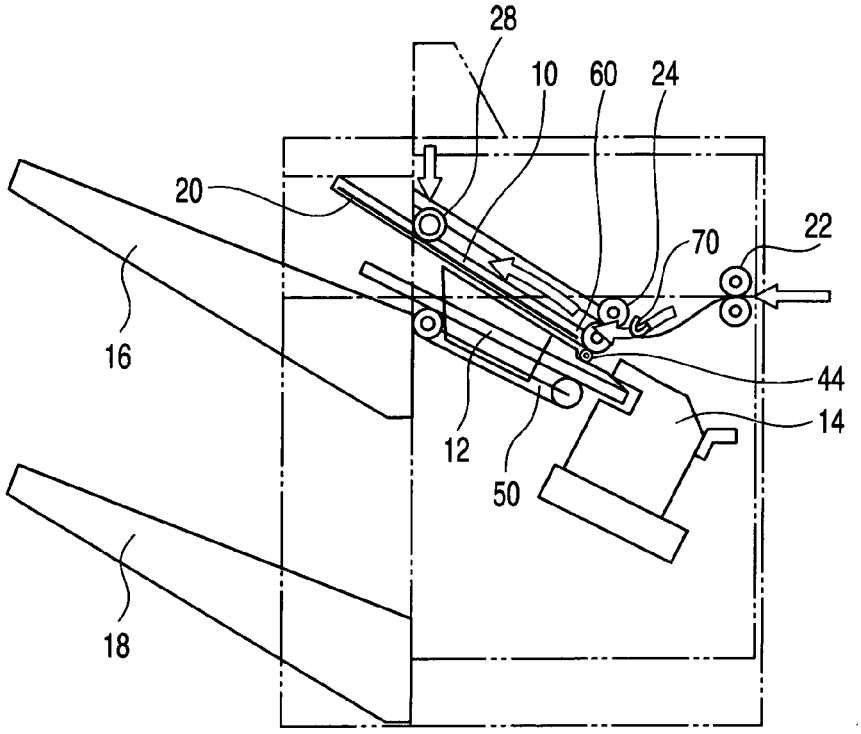
FIG. 8 is a view illustrating a flow of a first sheet of sheets between the paper feed roller and a standby roller in the post-process apparatus showing one embodiment of the invention.
Figure 9:
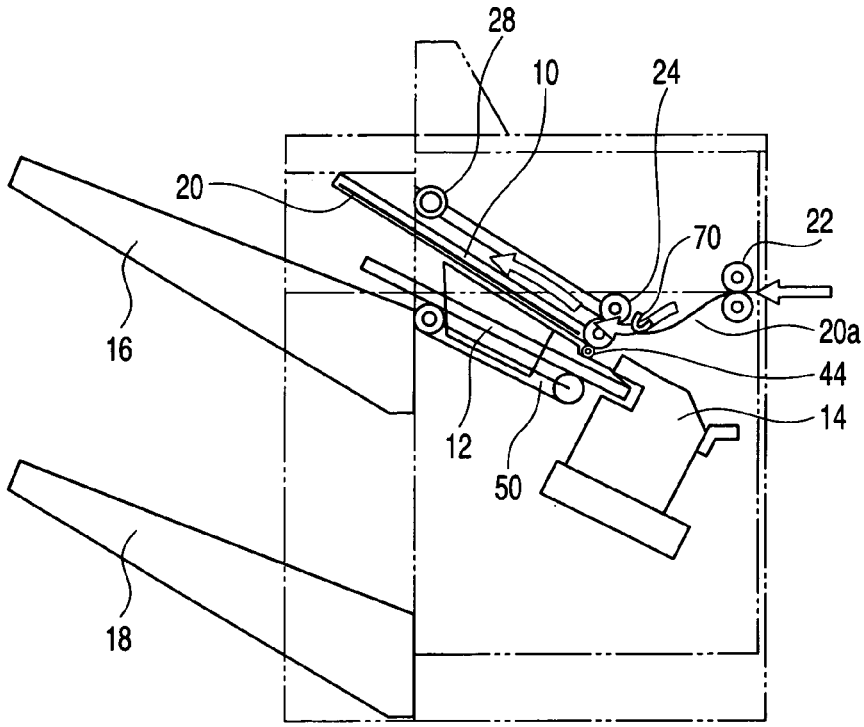
FIG. 9 is a view illustrating a flow of a second sheet of sheets between the paper feed roller and the standby roller in the post-process apparatus showing one embodiment of the invention.
Figure 10:
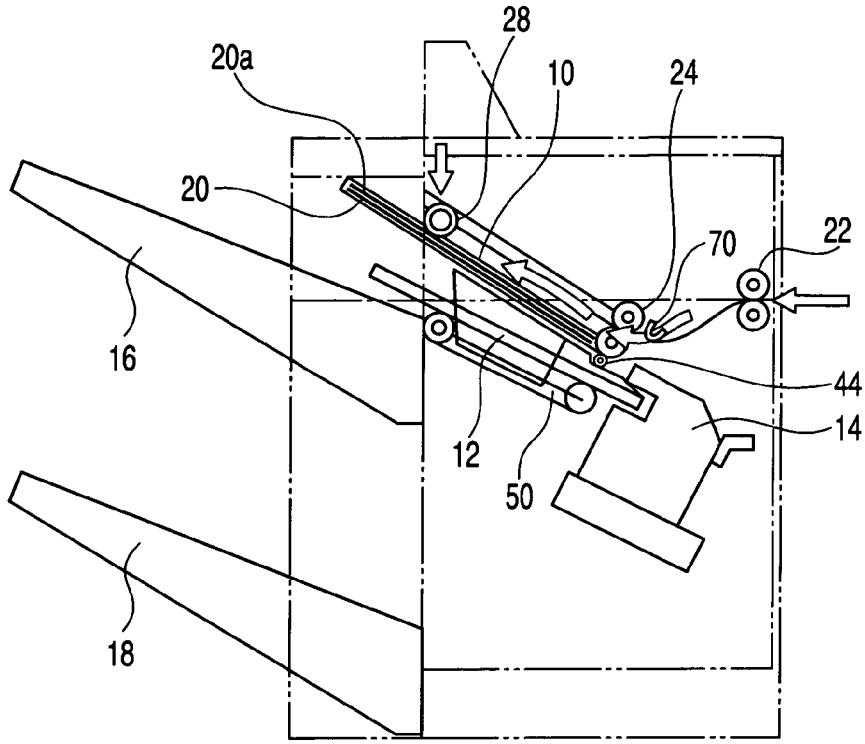
FIG. 10 is a view illustrating an operation of a waiting tray roller in the post-process apparatus showing one embodiment of the invention.

As shown in FIG. 6, the stapler 14 is positioned by a staple drive unit 49, and staple processing is controlled.

<Storage Tray>

As shown in FIG. 4, a bundle of staple processed sheets is sent to the storage tray 16 by a transport mechanism 50. Selection of the storage trays 16 and 18 is made by vertically moving the storage trays 16 and 18 by an storage tray drive unit 52.

In the case where a sheet is directly ejected from the waiting tray 10, the storage tray is risen up to a location which corresponds to a sheet outlet of the waiting tray.

(Description of Operation)

Now, an operation of a post-process apparatus according to the present invention will be described with reference to FIGS. 7 to 18.

<Operation in Case Where Staple Processing is Carried Out>

As has been already described, staple processing on the processing tray is slow as compared with processing on the image processing apparatus. Thus, when a sheet transported from the image processing apparatus is processed on the processing tray, a buffer unit is provided at a front stage thereof. Then, it is necessary to make standby until a next sheet has been transported to the processing tray when the sheet transported from the image processing apparatus is processed on the processing tray. In this example, a description will be given with respect to a case in which two sheets (a first sheet and a second sheet) are made standby on the waiting tray, and the third and subsequent sheets are not required to be standby.

A first sheet from the image processing apparatus is transported to the waiting tray 10 via the inlet roller 22 and the paper feed roller 24. The sheet is retained by the left and right lower face support members 10*a* and 10*b* and rear end retainer members at a first position. In this retention state, the waiting tray roller 28 is lowered, and a sheet distal end is aligned (aligned to the distal end 60 (upstream side) of the waiting tray 10).

Figure 11:
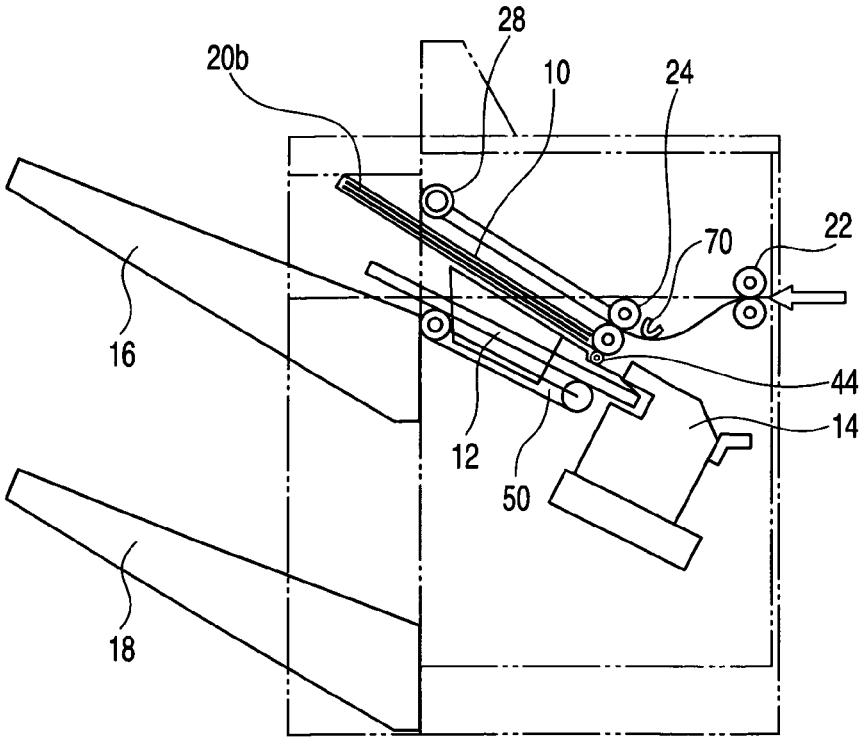
FIG. 11 is a view illustrating an operation of the waiting tray roller in the post-process apparatus showing one embodiment of the invention.
Figure 12:
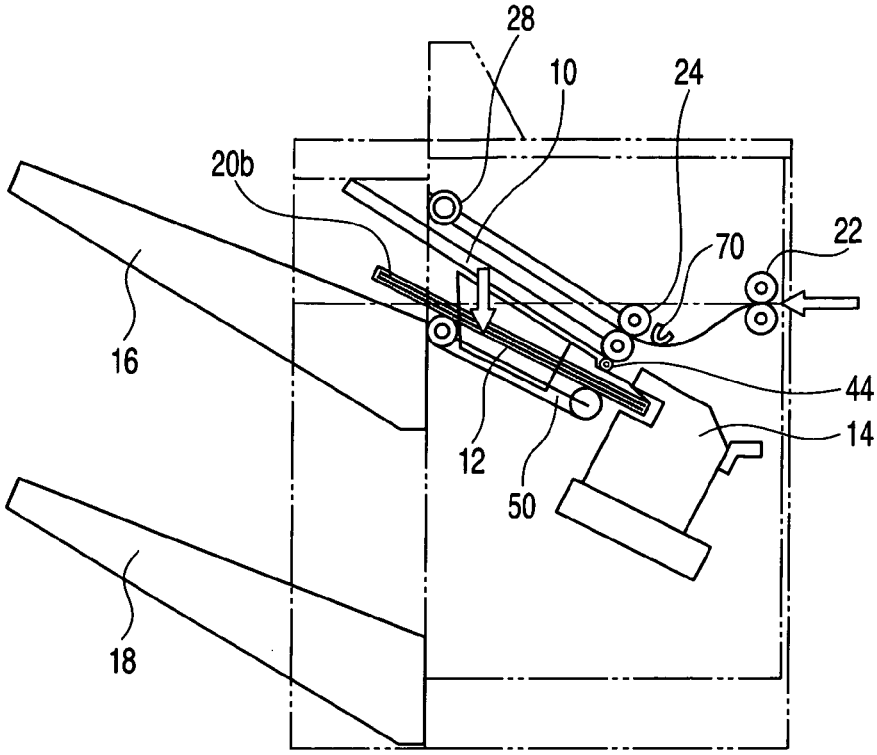
FIG. 12 is a view illustrating an operation of an active drop in the post-process apparatus showing one embodiment of the invention.

Next, a waiting tray roller 28 is risen, and is ready for receiving a second sheet 20*a*. When the second sheet 20*a* is sent to the waiting tray 10, the waiting tray roller 28 is lowered. A location of the sheet is aligned to the distal end 60 of the waiting tray 10. Then, the waiting tray roller 28 is risen (FIG. 11). When the second sheet is transported to the waiting tray, the distal end portion of the sheet is sensed by the sheet sensor 70. Based on this sense signal, a bundle of the first and second sheets are dropped onto the processing tray 12 altogether. That is, the left and right lower face support members 10*a* and 10*b* are opened upwardly or downwardly as shown in FIG. 20 or 21 to release the support on both sides of the sheet, thereby dropping the sheet. Namely, the lower face support members 10*a* and 10*b* are rotated downwardly or upwardly to drop the sheet.

Then, the third and subsequent sheets are transported from the paper feed roller 24 directly to the waiting tray while the waiting tray is kept in a state in which the support of the sheet is released.

Figure 13:
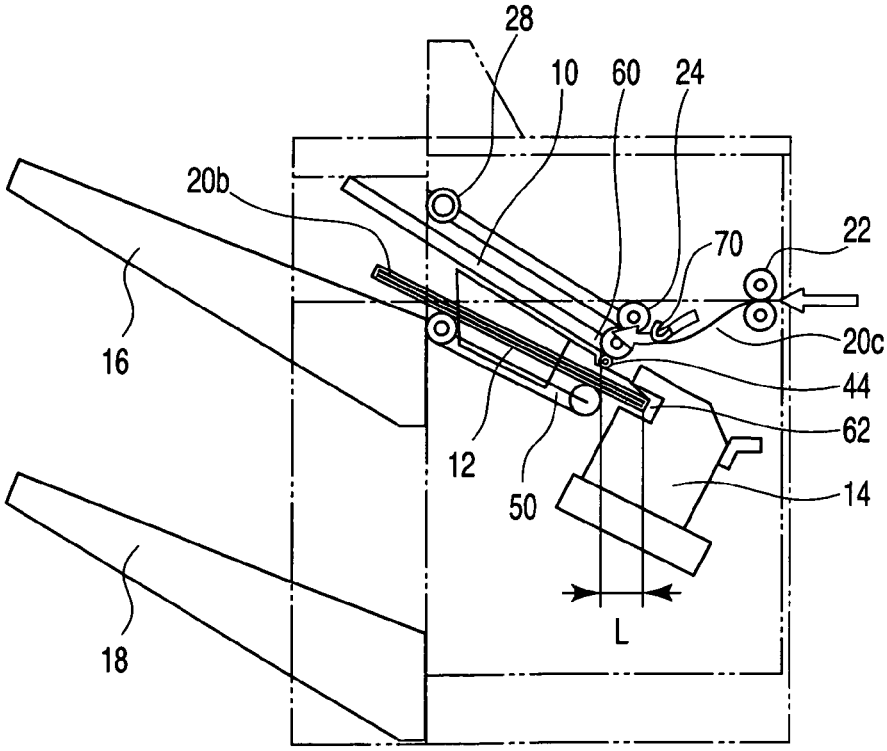
FIG. 13 is a view illustrating a flow of a third sheet of sheets in the post-process apparatus showing one embodiment of the invention.

Now, turning to FIG. 13, a state in which the second sheet is held on the processing tray 12 will be described here. In the processing tray 12, a predetermined number of sheet bundles 21 are formed to be stacked on two bundles of sheets 20*b*. At this time, longitudinal and transverse alignment mechanisms 38 and 47 function, and longitudinal and transverse sheet alignments are executed. At this time, as shown in FIG. 13, the distal end 60 of the waiting tray 10 and a distal end 62 (upstream side) of the processing tray 12 are spaced in a transverse direction with a distance L so that the distal end 60 of the waiting tray 10 exists at the downstream side more than the distal end 62 of the processing tray 12. With this construction, the bundle of sheets 20*b* is easily dropped from the waiting tray 10 to the processing tray 12, and an aligning operation by the longitudinal and transverse alignment mechanisms 38 and 47 can be easily carried out. As a result, an occurrence of jamming can be prevented.

The processing tray 12 is allocated to be obliquely inclined together with the waiting tray 10. Thus, the respective distal ends 60 and 62 are located at the lowest position. The sheets 20 and the bundle of sheets 21 can be aligned with the distal ends 60 and 62 by its own weight of the sheets 20 and the bundle of sheets 21.

Figure 14:
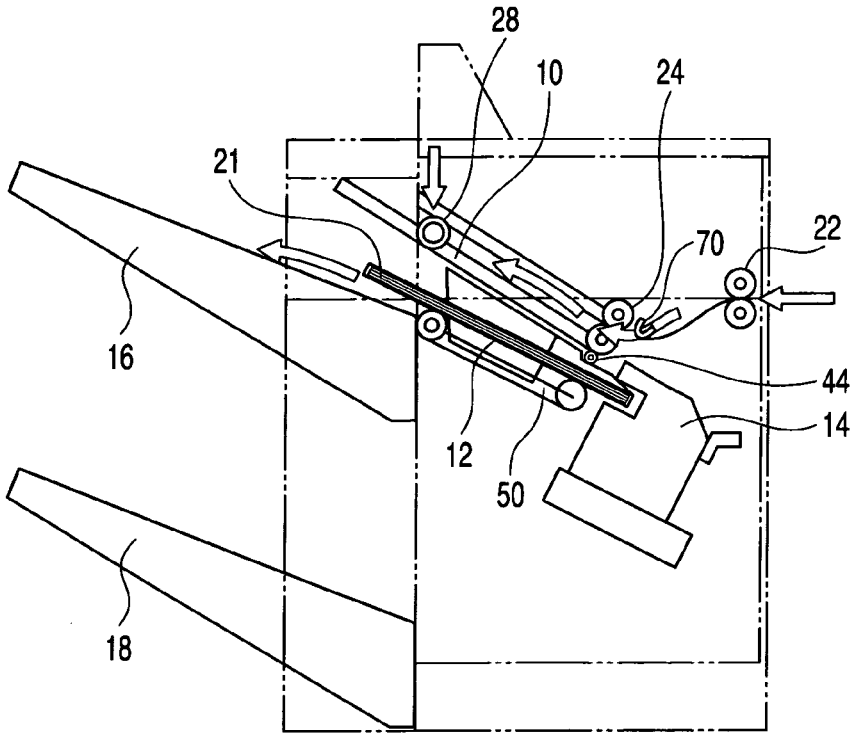
FIG. 14 is a view illustrating an operation of a stapler in the post-process apparatus showing one embodiment of the invention.
Figure 15:
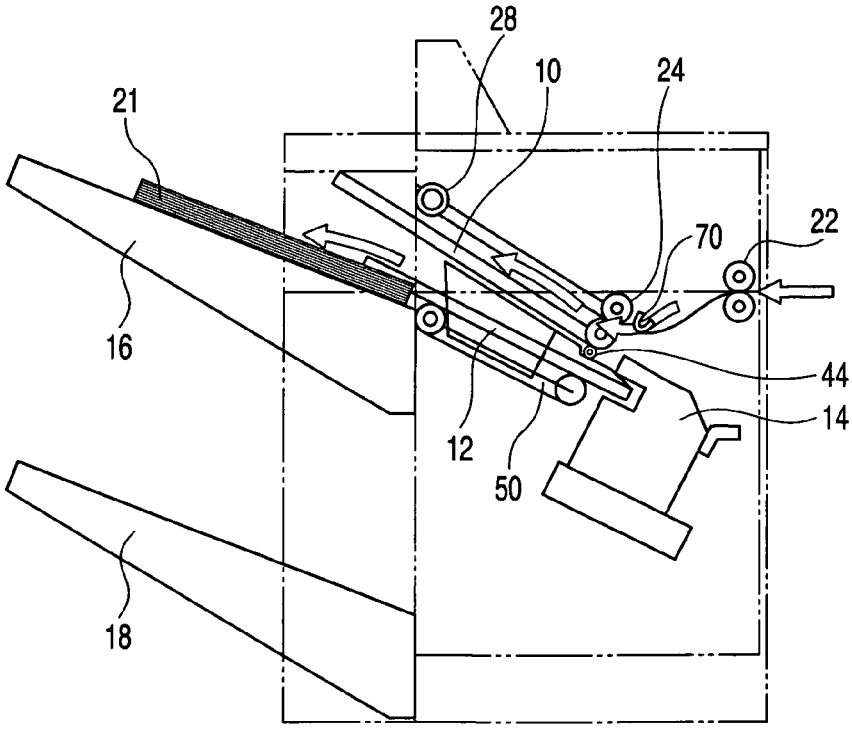
FIG. 15 is a view illustrating a flow of a bundle of sheets between a processing tray and a storage tray in the post-process apparatus showing one embodiment of the invention.

Next, as shown in FIG. 14, the bundle of sheets 21 is staple processed by the stapler 14. Then, as shown in FIG. 15, the bundle of sheets 20 is fed to the storage tray 16 by the transport mechanism 50, and post-process terminates.

<Operation in Case Where No Post-process is Required>

Figure 16:
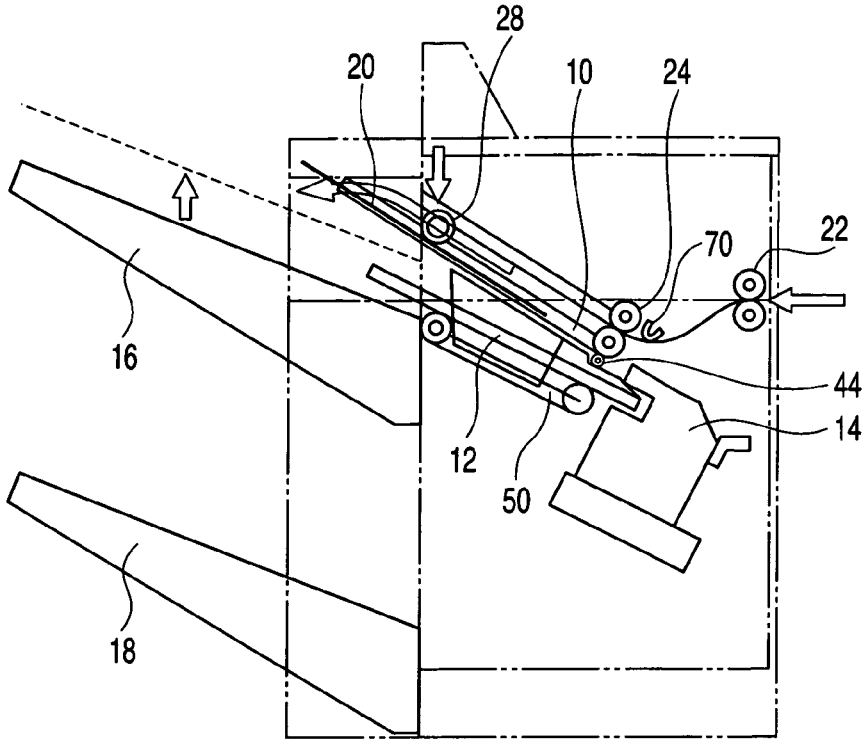
FIG. 16 is a view illustrating a flow of direct sheet ejection of a sheet from the waiting tray to the storage tray in the post-process apparatus showing one embodiment of the invention.
Figure 17:
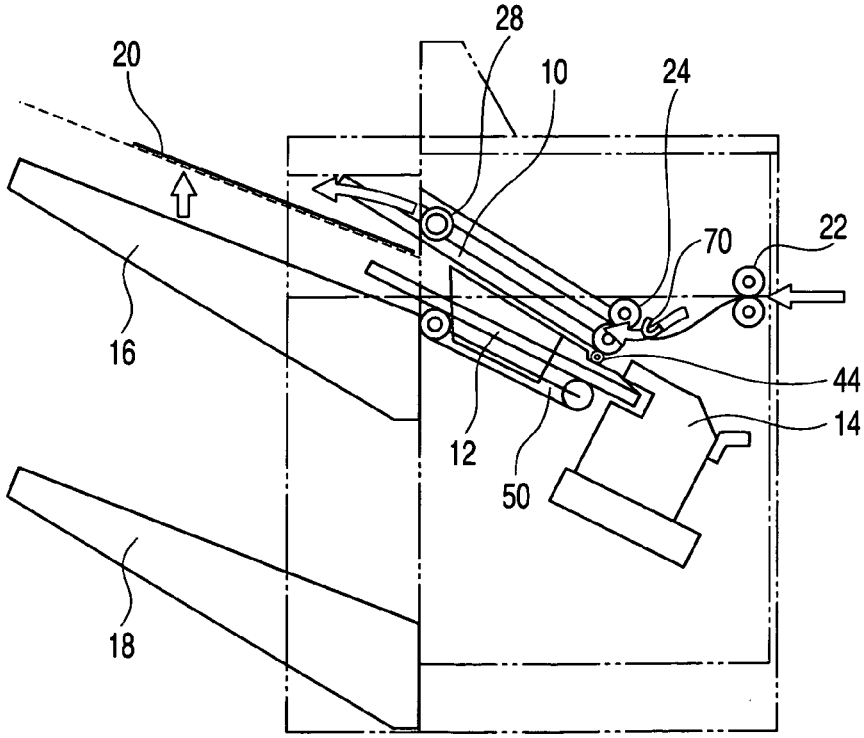
FIG. 17 is a view illustrating an operation of a position change of the storage tray in the post-process apparatus showing one embodiment of the invention.

In the case where no post-process is required (such as a case in which no staple processing is carried out or a case in which jamming has occurred), as shown in FIGS. 16 and 17, a sheet is ejected from the waiting tray 10 directly to the storage tray 16 without intervening the processing tray 12. As shown in FIG. 16, the sheet fed from the image processing apparatus is transported to the storage tray 16 via the inlet roller 22, the paper feed roller 24, and the waiting tray 10. The waiting tray roller 28 is lowered, and the sheets 20 are transported. The storage tray 16, as shown in FIG. 17, is slightly risen by the storage tray drive unit 52 to receive the sheets fed from the waiting tray 10.

Although embodiments of the present invention have been described above, the present invention is not limited to the embodiments. Constituent elements shown in the embodiments can be changed to other constituent elements as long as they have the same functions.

What is claimed is:

1. A sheet post-process apparatus, the apparatus comprising:

a waiting tray which temporarily retains a transported sheet in a waiting mode and releases the retention to drop the sheet;

a processing tray which bundles the sheets dropped from the waiting tray to carry out predetermined processing and ejects the bundled sheets; and a storage tray which holds the bundles of the sheets processed and ejected on the processing tray, wherein the waiting tray comprises:

left and right lower face support members which support left and right lower faces in a sheet transport direction during retention in a waiting mode and release the support of the left and right lower faces during release of the retention;

a shaft which rotatably supports one side face of the left and right lower face support members; and a motor that rotates the left and right lower face support members upwardly or downwardly while the shaft is defined as a rotation center, thereby releasing retention of the sheets, wherein the processing tray and the waiting tray are shorter in length in the sheet transport direction thereof than a length of a standard sheet to be held, and wherein a part of a proximal end side in the sheet transport direction of the sheet to be held on the processing tray is held on the storage tray.

2. The sheet post-process apparatus according to claim 1, wherein the waiting tray is allocated proximal to an upper stage of the processing tray, and the processing tray and the waiting tray are allocated in an inclined shape which is high at a proximal end side of a sheet to be transported and which is low at a distal end side thereof.

3. The sheet post-process apparatus according to claim 1, further comprising a sheet-conveying mechanism which conveys the bundle of sheets from the processing tray to the storage tray.

4. The sheet post-process apparatus according to claim 1, wherein the processing tray holds other sheets conveyed without being conveyed to the waiting tray before the sheets are bundled.

5. The sheet post-process apparatus according to claim 1, further comprising a sheet-aligning mechanism which aligns the bundle of sheets with one another on the processing tray at transverse and longitudinal edges.

6. The sheet post-process apparatus according to claim 1, further comprising an alignment mechanism to align the sheets on the waiting tray.

7. The sheet post-process apparatus according to claim 1, further comprising a sensor that detects a proximal end and a distal end of the sheet.

8. A sheet post-process apparatus, the apparatus comprising:

means for temporarily retaining a transported sheet in a waiting mode and releasing the retention to drop the sheet;

means for bundling the sheets dropped from the means for temporarily retaining the sheets to carry out predetermined processing and eject the bundled sheets; and means for holding the bundles of sheets processed and ejected by the means for bundling the sheets, wherein the means for temporarily retaining the sheets comprises:

means for supporting left and right lower faces in a sheet transport direction during retention in a waiting mode and releasing the support of the left and right lower faces during release of the retention;

means for rotatably supporting one side face of the means for supporting left and right lower faces; and means for rotating the means for supporting left and right lower faces upwardly or downwardly while the means for rotatably supporting one side face is defined as a rotation center, thereby releasing retention of the sheets, wherein the means for temporarily retaining the sheets and the means for bundling the sheets are shorter in length in the sheet transport direction thereof than a length of a standard sheet to be held, and wherein a part of a proximal end side in the sheet transport direction of the sheet to be held on the means for bundling the sheets is held on the means for holding the bundles of sheets.

9. The sheet post-process apparatus according to claim 8, wherein the means for temporarily retaining the sheets is allocated proximal to an upper stage of the means for bundling the sheets, and the means for bundling the sheets and the means for temporarily retaining the sheets are allocated in an inclined shape which is high at a proximal end side of a sheet to be transported and which is low at a distal end side thereof.

10. The sheet post-process apparatus according to claim 8, further comprising means for conveying the bundle of sheets from the means for bundling the sheets to the means for holding the bundle of sheets.

11. The sheet post-process apparatus according to claim 8, wherein the means for bundling the sheets holds other sheets conveyed without being conveyed to the means for temporarily retaining the sheets before the sheets are bundled.

12. The sheet post-process apparatus according to claim 8, further comprising means for aligning the bundle of sheets with one another on the means for bundling the sheets at transverse and longitudinal edges.

13. The sheet post-process apparatus according to claim 8, further comprising means for aligning the sheets on the means for temporarily retaining the sheets.

14. The sheet post-process apparatus according to claim 8, further comprising means for sensing a proximal end and a distal end of the sheet.

* * * * *